US006102412A

United States Patent [19]

Staffaroni

[11] Patent Number: 6,102,412

[45] Date of Patent: Aug. 15, 2000

[54] SKATE WITH A MOLDED BOOT

[75] Inventor: Michael G. Staffaroni, Minnetonka, Minn.

[73] Assignee: Rollerblade, Inc., Eden Prairie, Minn.

[21] Appl. No.: 09/017,889

[22] Filed: Feb. 3, 1998

[51] Int. Cl.[7] ..... A63C 17/02; A43B 5/04

[52] U.S. Cl. ..... 280/11.22; 36/115

[58] Field of Search ..... 280/11.22, 11.2, 280/11.19, 11.21, 11.3, 11.31, 11.32, 11.33, 11.34, 811; 36/115, 119.1, 117.1

[56] References Cited

U.S. PATENT DOCUMENTS

| | | | |
|---|---|---|---|
| D. 296,150 | 6/1988 | Diaz . | |
| 4,183,156 | 1/1980 | Rudy . | |
| 4,219,945 | 9/1980 | Rudy . | |
| 4,245,406 | 1/1981 | Landay et al. . | |
| 4,322,893 | 4/1982 | Halvorsen . | |
| 4,322,895 | 4/1982 | Hockerson . | |
| 4,364,188 | 12/1982 | Turner et al. . | |
| 4,366,634 | 1/1983 | Giese et al. . | |
| 4,535,553 | 8/1985 | Derderian et al. . | |
| 4,759,136 | 7/1988 | Stewart et al. . | |
| 4,769,927 | 9/1988 | Liggett et al. . | |
| 4,890,397 | 1/1990 | Harada et al. . | |
| 5,046,267 | 9/1991 | Kilgore et al. . | |
| 5,297,349 | 3/1994 | Kilgore . | |
| 5,331,752 | 7/1994 | Johnson et al. | 36/115 |
| 5,342,070 | 8/1994 | Miller et al. | 36/115 |
| 5,343,639 | 9/1994 | Kilgore et al. . | |
| 5,353,459 | 10/1994 | Potter et al. . | |
| 5,397,141 | 3/1995 | Hoshizaki et al. | 36/115 |
| 5,437,466 | 8/1995 | Meibock et al. . | |
| 5,761,835 | 6/1998 | Okajima | 36/115 |
| 5,768,807 | 6/1998 | Caeran et al. | 36/115 |
| 5,784,809 | 7/1998 | McDonald | 36/115 |
| 5,797,610 | 8/1998 | Grande et al. | 280/11.22 |
| 5,839,736 | 11/1998 | Chiu et al. | 36/115 |
| 5,848,796 | 12/1998 | Meibock et al. | 36/115 |
| 5,855,380 | 1/1999 | Di Filippo et al. | 280/11.22 |
| 5,887,361 | 3/1999 | Cabanis et al. | 36/115 |
| 5,895,061 | 4/1999 | Gignoux | 280/11.22 |

OTHER PUBLICATIONS

English translation of Nordica Italian Model No. TV93U000011. (Open for public inspection 1994).

ASOLO Pathfinder–G–GV Brochure Admitted prior art as far as such Products/Brochures were commercially available prior to the filing date of the present invention.

ASOLO AFS Brochure Admitted prior art as far as such Products/Brochures were commercially available prior to the filing date of the present invention.

1998 Bauer Catalog, 6 pages.

*Primary Examiner*—Lanna Mai
*Assistant Examiner*—Jeffrey J. Restifo
*Attorney, Agent, or Firm*—Merchant & Gould P.C.

[57] ABSTRACT

A skate includes a rigid frame with a plurality of wheels and a skate boot coupled to the frame. The boot has a lower outer shell, an inner soft shoe and a vibration-dampening and shock-absorbing material bed at least partially interposed between the lower outer shell and the soft shoe. The lower outer shell has greater rigidity than the material bed and soft shoe and has greater flexibility than the rigid frame.

22 Claims, 4 Drawing Sheets

SKATE WITH A MOLDED BOOT

TECHNICAL FIELD

The present invention relates generally to roller skates. More particularly, the present invention relates to roller skates having a skate boot with a lower outer shell and a vibration-dampening and shock-absorbing material bed.

BACKGROUND

Roller skating, particularly in-line roller skating, has become extremely popular in recent years. In-line skates generally have a rigid frame and a skate boot attached to the frame. In-line skates also include a plurality of wheels mounted to the frame for rotation in a common plane. The frame carries the axles of the wheels, which are mounted in parallel spaced-apart alignment. Thus the frame and attached wheels provide a narrow lateral base on which a skater must balance while skating.

The boots of in-line skates generally include hard outer shells with an inner soft boot or liner. In some skates, the hard outer shell may be integrally molded with the soft liner. The liners are typically made of textiles, including leather, mesh, cloth and other soft fabrics. The hard outer shells are typically made of rigid or semi-rigid plastics. The hard outer shells provide necessary support, while the soft liners provide comfort for the skater's foot. The soft liners do not provide the support that the hard outer shells provide.

In-line skating allows high speed and maneuverability, but also requires skill, strength and coordination by the skater. Skill and coordination are required to maintain lateral balance on the narrow frame and single plane of wheels on each skate. Strength is required to build up speed and exert lateral forces for turning. A typical skating motion includes a skater exerting lateral and downward pressure with a foot and lifting the foot and skate with every stride. The skater alternates these movements between each foot until a desired speed is reached. Also, the skater will continue to perform the skating motion to maintain a desired speed.

Because the repetitive motion of lifting each skate can be tiresome and cause fatigue, it is desirable to have a skate as lightweight as possible. Some skates, therefore, provide only portions of a hard outer shell in order to reduce the weight of the skate. For example, U.S. Pat. No. 5,437,466 issued to Meibock et al., provides a rigid or semi-rigid heel counter and toe counter with only the soft shoe portion provided along the sides of the foot in the arch region between the heel and toe counters. Thus, little support is provided to the foot in this area. Also, the soft shoe is non-removably connected to the hard outer shell portions. Therefore, once the fabric of the soft shoe begins to wear, the comfort is significantly diminished as there is less protection of the foot from the hard outer shell portions.

Other skates, having hard outer shells surrounding a significant portion of the skater's foot and having an inner soft liner can also be problematic. While such skates provide support to a substantial portion of the skater's foot, the skates tend to be heavy. In addition, the outer shell generally does not provide desirable shock absorption or vibration dampening when the skater's foot exerts pressure within the boot. The soft liner is constricted by the hard outer shell and, as the foot moves or exerts pressure within the liner, the liner abuts the hard outer shell thereby minimizing any shock absorption or vibration dampening.

Similarly, many ski boots also have hard outer shells surrounding the entire foot and part of the lower leg. For example, Italian Patent No. TV93U000011 filed by Nordica, S.p.A. on Mar. 17, 1993, discloses a ski boot having a hard outer shell and a shock absorbing midsole between the shell and sole. The hard outer shell of this boot provides sufficient lateral support such that the midsole extends upwardly from the sole only in the toe and heel areas. That is, the reference does not show extending the midsole to provide support along the sides of the mid-section or arch area of the foot because the hard outer shell is already positioned along these areas.

The present invention provides a solution to these and other problems and offers other advantages over the prior art.

SUMMARY

The present invention relates to a skate having a rigid frame with a plurality of skate wheels rotatably secured thereto. A skate boot, configured to receive a skater's foot, is operably coupled to the frame. The skate boot includes a lower outer shell, a soft shoe, and a vibration dampening material bed at least partially interposed between the lower outer shell and the soft shoe. The lower outer shell has a sole and sidewalls extending upwardly from the sole. The material bed also has a sole and sidewalls extending upwardly from the sole. The material bed is positioned at least partially within the lower outer shell such that the sole of the material bed overlays the sole of the lower outer shell and at least a portion of the sidewalls of the material bed engages at least a portion of the sidewalls of the lower outer shell. A portion of each of the sidewalls of the material bed extends substantially longitudinally adjacent to an area along which an arch of a user's foot extends when the user is wearing the boot. In one embodiment, the material bed is made of an open cell, shock-absorbing foamed material.

DETAILED DESCRIPTION

Figure 1:
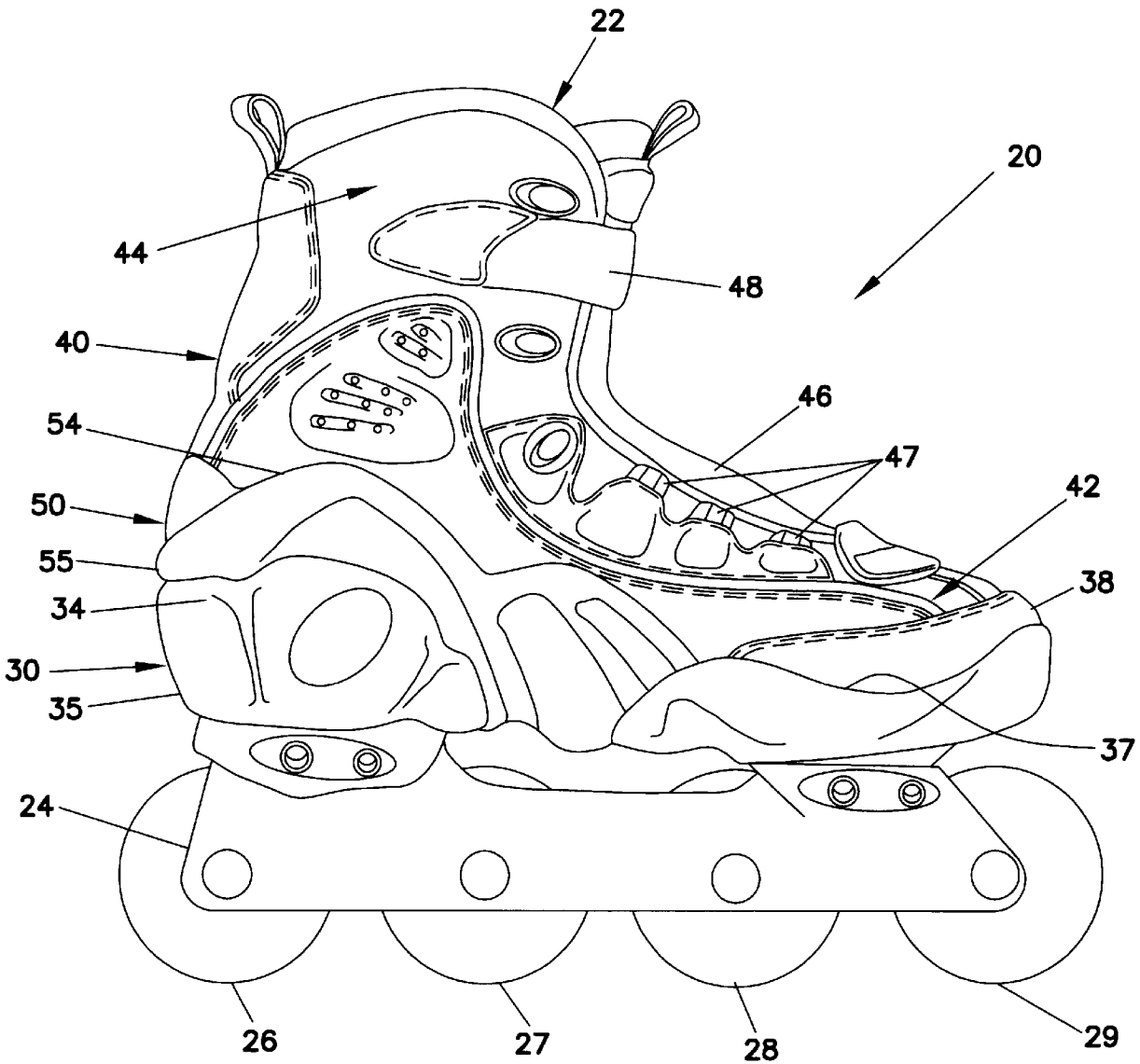
FIG. 1 is a right side elevational view of one embodiment of a skate for a right foot having a frame and a skate boot constructed in accordance with the principles of the present invention.

With reference to the drawings in which like elements are numbered identically throughout, a detailed description of the invention is provided. This description does not limit the scope of the invention, which is limited only by the scope of the attached claims.

In general terms, the present invention relates to an in-line skate 20 with a skate boot 22 and a rigid frame 24 to which the skate boot 22 is operably coupled. Each of the illustrated skates in the drawings is a right skate, and is used in combination with a left skate constructed in the mirror-image of the particular right skate. The frame 24 has a plurality of wheels 26, 27, 28 and 29 rotatably secured to the frame 24 about individual axes and substantially aligned in a common plane of rotation. The skate boot 22 includes a rigid or semi-rigid lower outer shell 30, an inner soft shoe 40 and a vibration-dampening and shock-absorbing material bed 50 that is at least partially interposed between the inner soft shoe 40 and the lower outer shell 30.

With reference to FIG. 1, the frame 24 of the skate 20 has a platform with one side adjacent to the boot 22 and an opposite side opposing the plurality of wheels 26, 27, 28, and 29 that are rotatably secured to the frame 24. Typically, the frame is formed of structurally rigid plastic such as, for example, glass reinforced nylon, polypropylene or other like materials. It will be apparent to those in the art that the frame 24 can be constructed in a variety of configurations.

Figure 2:
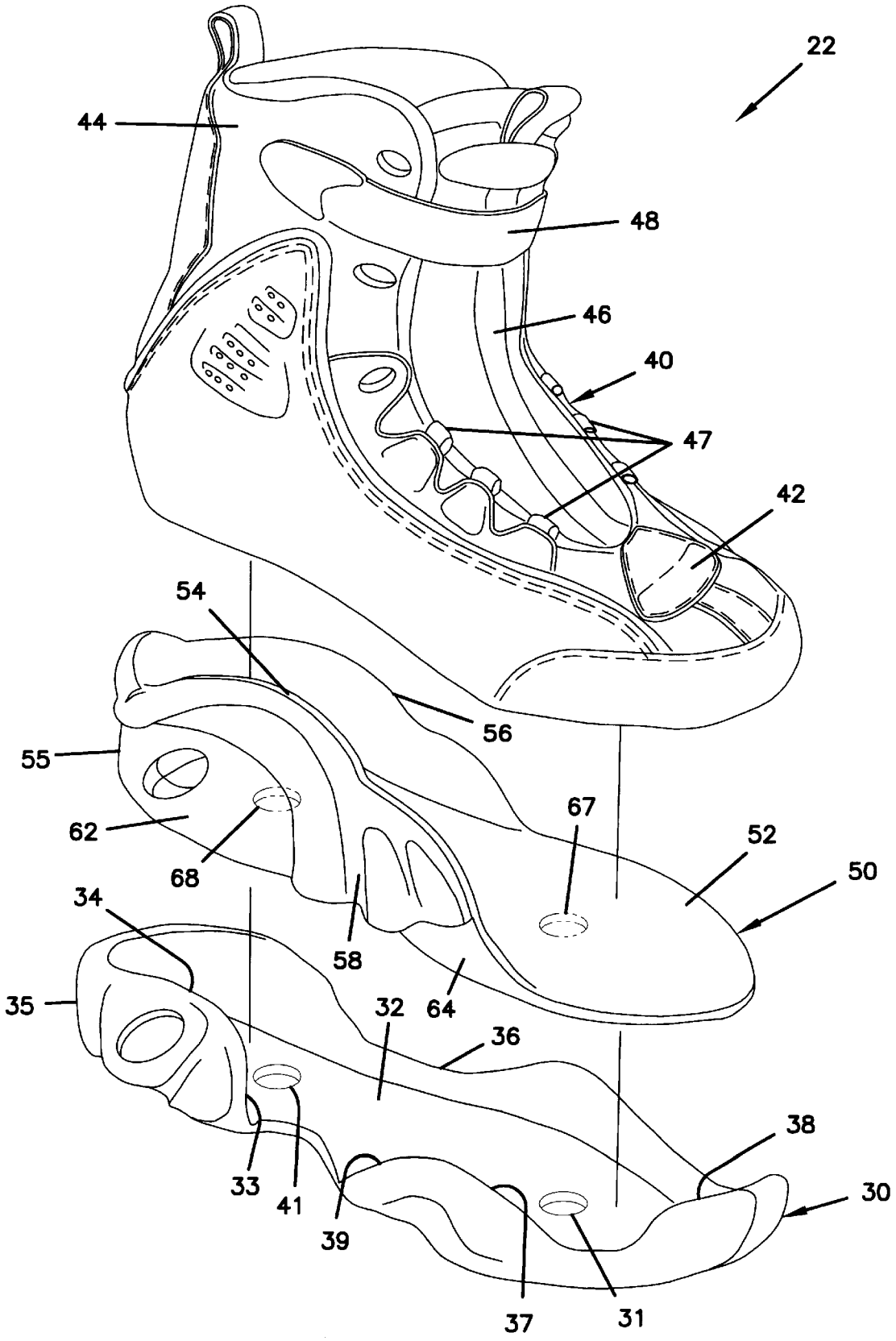
FIG. 2 is an exploded, right, top and front side perspective view of the skate boot of FIG. 1.

With reference to FIGS. 1 and 2, the lower outer shell 30 is shown. The lower outer shell 30 has a sole 32, a lateral rear sidewall 34, a medial sidewall 36 and a toe support 38. The lateral rear sidewall 34, the medial sidewall 36 and the toe support 38 all extend upwardly from the sole 32. The lateral rear sidewall 34 and the medial sidewall converge at the rear of the boot 22 to form a heel counter 35. The lateral rear sidewall 34 has a terminating end 33 approximately adjacent to the area where the arch of a skater's foot ends when the skater is wearing the boot 22. The medial sidewall 36 converges with the toe support 38 to form a continuous upwardly extending sidewall along the medial side and toe area of the lower outer shell 30. The toe support 38 has a lateral side extension 37 extending along the forward lateral side of the boot. The lateral side extension 37 has a terminating end 39 approximately adjacent to the area where the arch of the skater's foot begins when the skater is wearing the boot 22. Thus, in the embodiment shown in FIG. 1, there is a sidewall gap between the terminating end 33 of the lateral rear sidewall 34 and the terminating end 39 of the lateral side extension 37. The sidewall gap is generally positioned longitudinally adjacent to the area along which the arch of a skater's foot extends when the skater is wearing the boot 22. Similarly, a downward curve of the medial sidewall 36 is generally positioned longitudinally adjacent to the area along which the arch of the skater's foot extends when wearing the boot 22.

The lower outer shell 30 is preferably made of rigid or semi-rigid materials. Such materials include urethane, polyurethane and other similar materials. In one preferred embodiment, the lower outer shell 30 is made of polyurethane having a reading not less than 64 shore D durometer and not greater than 70 shore D durometer. In referring to the relative hardness of the materials used to construct the lower outer shell 30, it is to be understood that, relative to the soft shoe 40 and the material bed 50 the lower outer shell 30 will have greater rigidity, and that, relative to the frame 24 the lower outer shell 30 will have more flexibility.

The inner soft shoe 40 is shown in FIGS. 1 and 2 and is constructed for receiving the skater's foot. The soft shoe 40 is designed with a foot portion 42, a cuff portion 44 and a tongue 46. Generally, the soft shoe portion 40 is made of soft or non-rigid textile materials such as leather, mesh or cloth materials. The soft shoe 40 may have mechanisms for securing the soft shoe 40 around the skater's foot such as, for example, a lacing configuration 47 and a conventional strap and buckle configuration 48 as shown in FIGS. 1 and 2. It will be apparent to those in the art that a variety of securing mechanisms and any combination thereof could be used on the skate boot 22, including a single closure device as disclosed in commonly-assigned U.S. Pat. No. 5,570,522. The tongue 46 may include a rigid or semi-rigid member to provide support to the top of the skater's foot and leg. Such a member is typically integrally molded, glued or stitched to the soft materials of the tongue 46.

Figure 8:
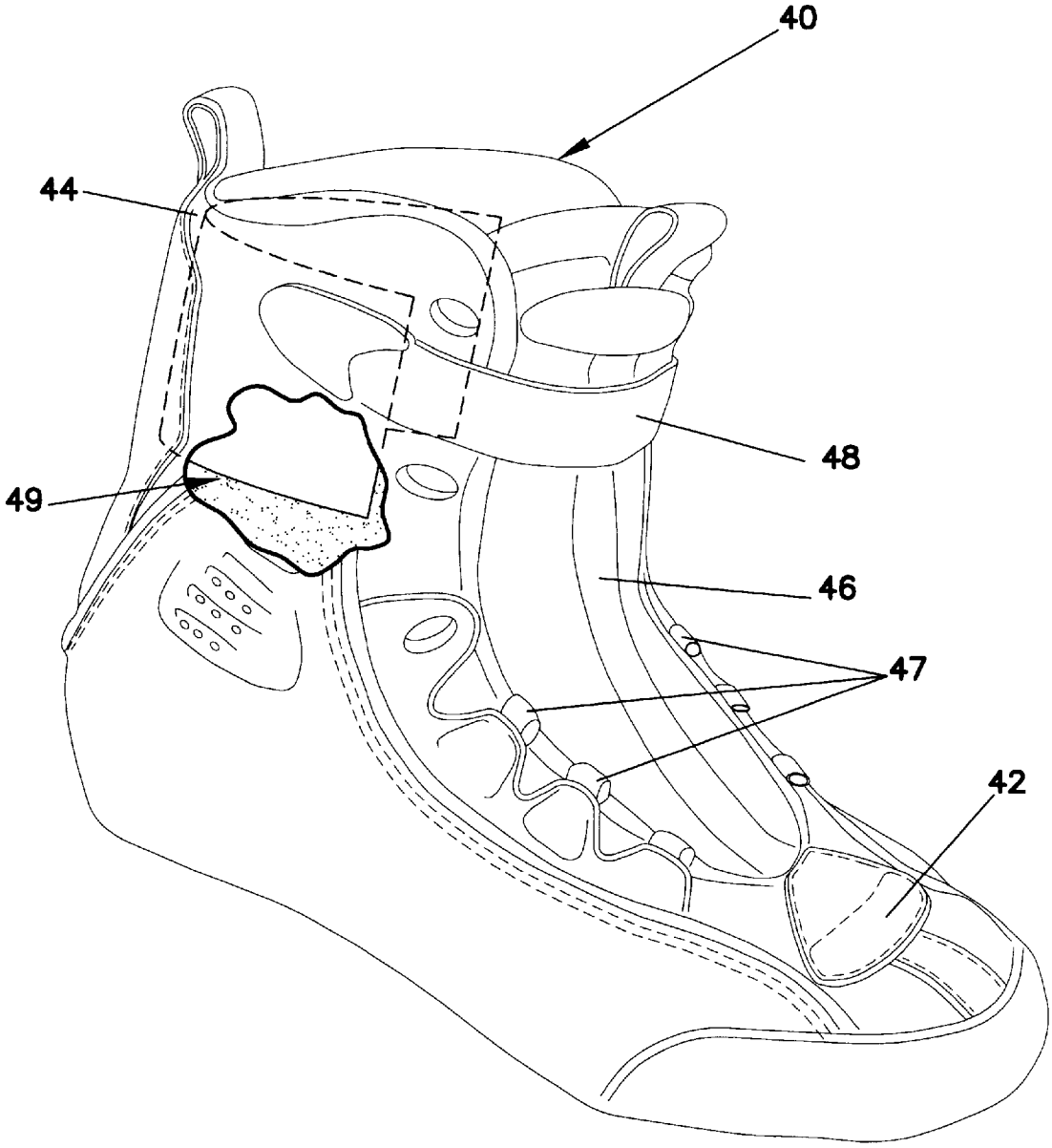
FIG. 8 is a right, top and front side perspective view of a soft shoe of the skate boot of FIG. 1, with an area of the soft shoe broken away to show a hidden cuff support member that is otherwise shown in phantom lines.

With reference to FIG. 8, the boot 22 typically includes a rigid or semi-rigid cuff support member 49 (partly shown in a broken away area of the soft shoe and otherwise shown in phantom lines) to provide support to the cuff portion 44 of the soft shoe 40. In the embodiment shown in FIG. 8, the cuff support member 49 is integrally molded within the cuff portion 44 and is not directly attached to the lower outer shell 30. The cuff support member 49 is preferably made of molded plastic, fiber board or other suitable materials. It will be apparent to those in the art that the cuff support member 49 does not have to be integrally molded within the soft shoe 40, but could surround the cuff portion 44 of the soft shoe 40. In addition, the cuff support member 49 could be directly connected to the lower outer shell 30. The cuff support member 49 could also be pivotally or otherwise movably connected to the lower outer shell 30. It will also be apparent to those in the art that the soft shoe 40 may be one continuous soft shoe or may be separated into upper and lower portions as is known in the art.

Figure 3:
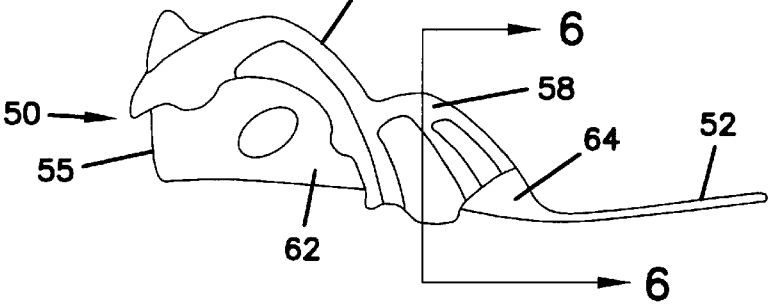
FIG. 3 is a right side elevational view of a vibration dampening and shock absorbing material bed of the skate boot of FIG. 1.
Figure 5:
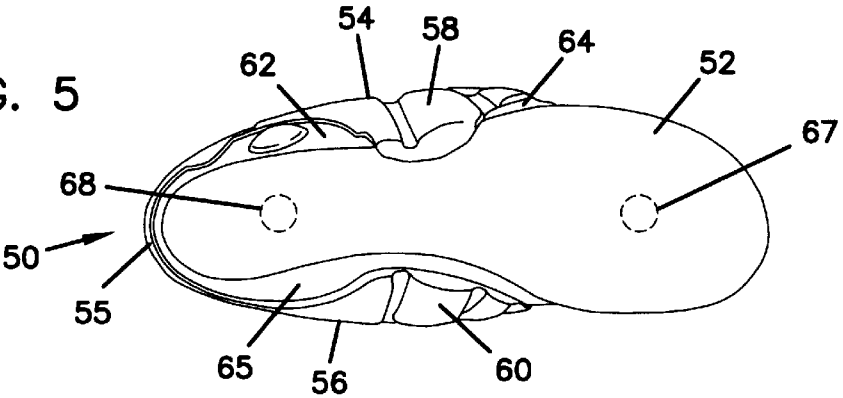
FIG. 5 is a bottom plan view of the vibration dampening and shock absorbing material bed of the skate boot of FIG. 1.
Figure 4:
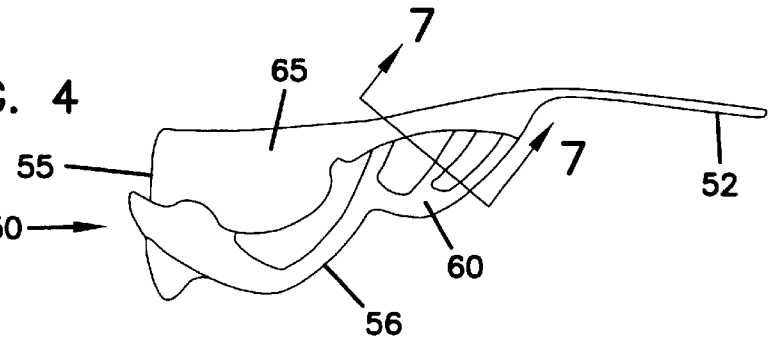
FIG. 4 is a left side, inverted elevational view of the vibration dampening and shock absorbing material bed of the skate boot of FIG. 1.

With reference now to FIGS. 2–5, the shock-absorbing material bed 50 is shown. The right and left side elevational views are shown in FIGS. 3 and 4, respectively, and the bottom plan view is shown in FIG. 5. The material bed 50 includes a sole 52, a lateral sidewall 54 and a medial sidewall 56. The lateral and medial sidewalls 54 and 56 extend upwardly from the sole 52 and are positioned on opposing sides of middle and heel portions of the material bed 50. A portion of each of the lateral and medial sidewalls 54 and 56 is positioned generally longitudinally adjacent to the area along which the arch of the skater's foot extends when the skater is wearing the skate boot 22. The lateral and medial sidewalls 54 and 56 converge at the rear of the material bed 50 to form a heel cup 55 around the heel of the skater's foot. In one preferred embodiment, the heel cup 55 of the joined lateral and medial sidewalls 54 and 56 is at least 10 mm in height from the sole. The sidewalls 54 and 56 each have exposed areas 58 and 60, and mating areas, 62, 64 and 65.

The material bed 50 is preferably made of a material that provides shock-absorption and vibration-dampening to the skater's foot. In a preferred embodiment, the material bed 50 is made of an open cell, foamed polyurethane or foamed ethylene vinyl acetate (EVA). The foamed polyurethane would preferably be made in the range of 50 to 80 Asker C. In a preferred embodiment, the foamed polyurethane would not be less than 55 Asker C and would not be greater than 60 Asker C. A variety of manufacturing methods could be used to manufacture the material bed 50. For example, the foamed EVA could be compression or injection molded and the foamed polyurethane could be poured. In addition, other materials may also be used. For example, a gel that may or may not be foamed could be extruded or compression or injection molded to form the material bed 50. Also, other elastomeric materials designed to flex and absorb shock by compressing could be used to form the material bed 50.

Figure 6:
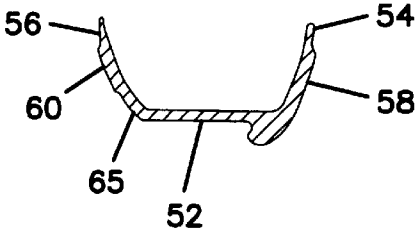
FIG. 6 is a cross-sectional-view taken along section line 6—6 of FIG. 3.
Figure 7:
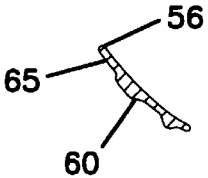
FIG. 7 is a cross-sectional view taken along section line 7—7 of FIG. 4.

FIGS. 6 and 7 show cross-sectional views of the material bed 50 taken along line 6—6 of FIG. 3 and line 7—7 of FIG. 4, respectively. As shown in the cross-sectional views, at least some portions of the exposed areas 58 and 60 are generally thicker than the mating areas 62, 64 and 65 and the sole 52. The preferred thickness of the material bed 50 is not less than 2 mm and not greater than 8 mm. In one preferred embodiment, the sole 52 and the mating areas 62, 64 and 65 of the material bed 50 are approximately 3 mm, with portions of the exposed areas 58 and 60 being slightly thicker. The width of the material bed 50 is significant because a thickness less than 2 mm thick may reduce the vibration-dampening and shock-absorption capabilities, and may decrease the support provided by the material bed 50 to the skater's foot, thus decreasing the skater's comfort. A material bed thickness greater than 8 mm will likely produce too much cushion, thereby minimizing support and creating a sloppy feel.

As shown in FIGS. 1 and 2, when the material bed 50 is connected to the lower outer shell 30 the mating areas 62 and 65 of the sidewalls 54 and 56 of the material bed 50, respectively, engage inner sides of the sidewalls 34 and 36 of the lower outer shell 30, respectively. The mating area 64 of the lateral sidewall 54 of the material bed 50 engages a portion of an inner side of the lateral side extension 37 of the lower outer shell 30. Also, the sole 52 of the material bed 50 is constructed with substantially the same outer contour as the sole 32 of the lower outer shell 30. Therefore, when the material bed 50 is connected to the lower outer shell 30, the sole 52 of the material bed 50 engages the sole 32 of the lower outer shell 30. The exposed areas 58 and 60 of the material bed sidewalls 54 and 56 are not enclosed by the lower outer shell 30 and, therefore, are visible from the outside of the boot 22.

In one preferred embodiment the material bed 50 is adhered to the lower outer shell 30 with an adhesive such as glue. It will be apparent, however, that other means could be used to secure the material bed 50 to the lower outer shell 30, such as, for example, bolts, rivets or other mechanical type connectors.

The soft shoe 40 is also operably connected to the lower outer shell 30 and material bed 50. The foot portion 42 of the soft shoe 40 is designed to fit within the material bed 50 and the toe support 38 of the lower outer shell 30. In one preferred embodiment, the soft shoe 40 is adhered to the material bed 50 with a permanent adhesive such as glue. However, it will be apparent to those in the art that the soft shoe 40 could be made as a removable liner wherein a non-permanent mechanical connection secures the liner within the material bed 50 and lower outer shell 30.

The lower outer shell 30, the material bed 50 and the soft shoe 40, are operably connected to the frame 24. In FIGS. 2 and 5, openings are shown in the lower outer shell 30 and the material bed 50 for connecting to the frame 24. The sole 32 of the lower outer shell 30 includes a toe opening 31 and a heel opening 41 for receiving bolts, rivets or other connecting mechanisms for connecting the lower outer shell 30 to the frame 24. Similarly, a toe opening 67 and a heel opening 68 are shown in phantom lines on the material bed 50. The toe and heel openings 67 and 68 of the material bed 50 correspond to the toe and heel openings 31 and 41 of the lower outer shell 30, respectively, and may be used to secure the material bed 50 to the lower outer shell 30 and the frame 24. It will be apparent to those in the art that openings could also be provided in the soft shoe 40, such that the soft shoe 40 is secured to the material bed 50, the lower outer shell 30 and the frame 24 with bolts, rivets or the like. In a preferred embodiment, however, the bolts, rivets or other securing mechanisms extend only through the lower outer shell 30. The material bed 50 and soft shoe 40 are secured with adhesives as previously described herein.

When in use, the in-line skate 20 constructed in accordance with the principles of the present invention provides a skate that offers comfort in addition to desired support for the skater. The lower outer shell 30 is constructed with materials rigid enough to provide the necessary lateral support for the skater's foot. The material bed 50 provides a shock-absorbing and vibration-dampening member around the heel, sides and bottom of the skater's foot. In addition, the material bed 50 provides support and comfort on both sides of the skater's foot adjacent to the area along which the arch of the skater's foot extends when the skater is wearing the skate boot 22. The preferred foamed polyurethane material is more flexible than the lower outer shell 30 and provides greater support than the soft shoe 40. Thus, the unique combination of a soft shoe, a foamed material bed and a hard lower outer shell provides combined comfort, support, vibration-dampening and shock-absorption not previously offered in skates.

It is to be understood that even though numerous characteristics and advantages of various embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

The claimed invention is:

1. A skate, comprising:

a frame having a plurality of skate wheels rotatably secured thereto;

a boot including a rigid lower outer shell, a soft shoe, and a vibration dampening material bed at least partially interposed between said rigid lower outer shell and said soft shoe, said boot operably connected to said frame;

said lower outer shell including a sole and sidewalls extending upwardly from said sole, said rigid lower outer shell being constructed with materials having greater rigidity relative to said material bed and said soft shoe, and having less rigidity relative to said frame;

said soft shoe including a foot portion and a cuff portion;

said material bed including a heel portion, a sole extending from said heel portion to at least an area along which an arch of a user's foot extends when the user is wearing said boot, and sidewalls extending upwardly from said sole, said material bed positioned at least partially within said rigid lower outer shell such that said sole of said material bed overlays at least a portion of said sole of said rigid lower outer shell and mating portions of said sidewalls of said material bed engage at least a portion of said sidewalls of said rigid lower outer shell with at least one of said mating portions of said sidewalls extending upwardly from said sole and extending longitudinally from said heel portion to at least the area along which the arch of the user's foot extends when the user is wearing said boot; and wherein each of said sidewalls of said material bed includes a portion positioned substantially longitudinally adjacent to the area along which the arch of the user's foot extends when the user is wearing said boot.

2. The skate of claim 1 wherein said skate wheels are aligned in substantially a same plane of rotation.

3. The skate of claim 1 wherein said material bed is made of foamed polyurethane having a measurement of at least 55 Asker C and not greater than 60 Asker C.

4. The skate of claim 3 wherein said material bed has a thickness of at least 3 mm.

5. The skate of claim 1 wherein said sole of said material bed has a vertical thickness of at least 3 mm and not greater than 5 mm.

6. The skate of claim 1 wherein said sidewalls of said material bed extend above at least a portion of said lower outer shell, said sidewalls of said material bed converging to surround a heel of said user's foot.

7. The skate of claim 1 wherein said material bed is fixedly secured to said lower outer shell.

8. The skate of claim 7 wherein said material bed is glued to said lower outer shell.

9. The skate of claim 1 wherein said lower outer shell is made of polyurethane having a reading of at least 64 Shore D durometers and not greater than 70 Shore D durometers.

10. The skate of claim 1 wherein said boot further comprises a cuff support member connected to said cuff portion of said soft shoe.

11. A skate, comprising:

a frame having a plurality of skate wheels rotatably secured thereto;

a boot including a rigid lower outer shell, a soft shoe, and a vibration-dampening material bed at least partially interposed between said rigid lower outer shell and said soft shoe, said boot operably coupled to said frame;

said rigid lower outer shell including a sole and sidewalls extending upwardly from said sole, said rigid lower outer shell being constructed with materials having greater rigidity relative to said material bed and said soft shoe, and having less rigidity relative to said frame;

said soft shoe including a foot portion and a cuff portion;

said material bed including a heel portion, a sole extending from said heel portion to at least an area along which an arch of a user's foot extends when the user is wearing said boot, and sidewalls extending upwardly from said sole, said material bed positioned at least partially within said rigid lower outer shell such that said sole of said material bed overlays at least a portion of said sole of said rigid lower outer shell and mating portions of said sidewalls of said material bed are adjacent to at least a portion of said sidewalls of said rigid lower outer shell with at least one of said mating portions of said sidewalls extending upwardly from said sole and extending longitudinally from said heel portion to at least the area along which the arch of the user's foot extends when the user is wearing said boot; and wherein said material bed is made of a foamed polyurethane material.

12. The skate of claim 11 wherein said skate wheels are aligned in a substantially a same plane of rotation.

13. The skate of claim 11 wherein said material bed has a thickness of at least 3 mm.

14. The skate of claim 11 wherein said sole of said material bed has a vertical thickness of at least 3 mm and not greater than 5 mm.

15. The skate of claim 11 wherein each of said sidewalls of said material bed includes a portion positioned substantially longitudinally adjacent to an area along which an arch a user's foot extends when said user is wearing said boot.

16. The skate of claim 11 wherein said sidewalls of said material bed extend above at least a portion of said lower outer shell, said sidewalls of said material bed converging to surround a heel of a user's foot.

17. The skate of claim 11 wherein said material bed is fixedly secured to said lower outer shell.

18. The skate of claim 17 wherein said material bed is glued to said lower outer shell.

19. The skate of claim 11 wherein said lower shell is made of polyurethane having a reading of at least 64 Shore D durometers and not greater than 70 Shore D durometers.

20. The skate of claim 11 wherein said boot further comprises a cuff support member connected to said cuff portion of said soft shoe.

21. The skate of claim 1 wherein said material bed includes a toe portion, said sole of said material bed extending from said heel portion to said toe portion.

22. The skate of claim 11 wherein said material bed includes a toe portion, said sole of said material bed extending from said heel portion to said toe portion.

* * * * *